United States Patent [19]

Cox et al.

[11] Patent Number: 4,486,900

[45] Date of Patent: Dec. 4, 1984

[54] REAL TIME PITCH DETECTION BY STREAM PROCESSING

[75] Inventors: Richard V. Cox, Piscataway; Ronald E. Crochiere, Berkeley Heights, both of N.J.

[73] Assignee: AT&T Bell Laboratories, Murray Hill, N.J.

[21] Appl. No.: 363,470

[22] Filed: Mar. 30, 1982

[51] Int. Cl.[3] ..... G10L 1/00

[52] U.S. Cl. ..... 381/38; 364/728

[58] Field of Search ..... 381/38, 49; 364/513.5, 364/724, 728

[56] References Cited

U.S. PATENT DOCUMENTS

| | | | |
|---|---|---|---|
| 3,717,756 | 2/1973 | Stitt | 364/728 |
| 3,979,557 | 9/1976 | Schulman et al. | 381/49 |
| 4,081,605 | 3/1978 | Kitawaki | 179/1 |
| 4,282,406 | 8/1981 | Yato | 179/1 |

OTHER PUBLICATIONS

"A Microcomputer with Digital Signal Processing Capability," 1982, pp. 32, 33, 284 and 285, 1982 IEEE International Solid-State Circuits Conf.

*Primary Examiner*—E. S. Matt Kemeny

*Attorney, Agent, or Firm*—Robert O. Nimtz

[57] ABSTRACT

Continuous stream processing of an input signal to find the autocorrelation function and pitch period is simplied. The input speech signal is sampled at 8 khz, from which the autocorrelation function is formed by multiplying each sample by a stored-delay reduced sequence of up to 30 past samples. The reduced sequence is formed by every fourth sample of input signal gated to storage. Autocorrelation values are sequentially compared by a peak-peaker for maxima, thus further minimizing storage requirements to find the pitch period.

12 Claims, 4 Drawing Figures

REAL TIME PITCH DETECTION BY STREAM PROCESSING

TECHNICAL FIELD

Our invention relates to digital processing of speech signals and, in particular, to real time pitch detection.

BACKGROUND OF THE INVENTION

The parameter indicative of the pitch period is very important for speech sound analysis and synthesis because the pitch has a material effect on the quality of the synthesized speech sound. An error in the measurement of the pitch seriously affects the quality of the synthesized sound.

Some methods of pitch detection have been disclosed in U.S. Pat. No. 3,717,756 granted Feb. 20, 1973 to Stitt; U.S. Pat. No. 4,282,406 granted Aug. 4, 1981 to Yato; and U.S. Pat. No. 4,081,605 granted Mar. 28, 1978 to Kitawaki et el.

Some methods of pitch period detection use block processing of speech signals in which a finite number of consecutive samples of speech are periodically selected as a group and stored for processing. Such a pitch period detection method is useful in off line analysis. Stream processing of sample speech signals, on the other hand, is useful for real time processing. A continuous group of consecutive signal samples are selected, in stream processing, by passing the signal stream past a window. As each new sample is added to the group, the oldest sample is deleted.

A common problem in known methods of pitch detection relates to the substantial amount of memory required to process speech signal samples. Typically, in stream processing with pitch detection by the autocorrelation function (ACF), a window of about 320 samples at 8 KHz may be used. For each ACF value, there are required about 200 operations comprising multiplications and additions. Assuming about 100 ACF values are necessary, about 20,000 operations are needed for each estimate. Further, assuming about 200 shifts per second, about 4,000,000 operations per second are required. Additional processing, such as searching for the maximum, reading the ACF value from memory, writing the ACF value in memory, and the like, required for the AFC method of pitch detection would increase the number of operations to at least 16,000,000 operations per second.

Microprocessors built from a single chip are available on the market. These microprocessors are desirable, because of their size and cost, for use in speech processing. Some of these microprocessors, however, have small memory capacity for storage of dynamic data, for example, 120 words of 20 bits each, which is substantially less than the amount required as described above. Furthermore, available microprocessors do not meet the computation speed requirements. It is desirable to modify the ACF method of pitch detection to be able to use low cost and small size microprocessors.

SUMMARY OF THE INVENTION

The pitch of a speech pattern is determined by sampling the speech pattern at spaced time intervals to form a series of sample signals representative of the pattern. One sample signal in each successive sequence of Q consecutive sample signals is stored. The stored sample signals of the current and preceding sequences are processed over the time intervals of Q consecutive sample signals to generate a signal representative of the pitch of the speech pattern.

More particularly, in the preferred embodiment of this invention, every fourth sample is stored and a selected number of prior stored samples, that is, delayed samples, is retained in memory. Sixty-four autocorrelation function (ACF) estimates are computed over a period spanning four successive samples, using the aforesaid stored samples. These estimates are also stored in memory. In order to avoid pitch doubling errors, each ACF sample is weighted. The maximum weighted ACF estimate is selected to determine the pitch. Furthermore, instead of retaining all sixty-four weighted ACF estimates, as in the prior art, the first weighted ACF estimate is stored. Thereafter, each successive weighted ACF estimate is compared with the one previously stored and the larger of the two retained, thereby identifying the maximum ACF estimate. The delay, or lag, corresponding to the maximum weighted ACF estimate is an estimate of pitch.

By processing every fourth sample over a period spanning four samples, less storage space and slower processing speeds are required. Furthermore, because only the maximum weighted ACF estimate is stored, a further reduction in memory is realized. These advantages permit the use of microprocessors that are fabricated from a single chip.

DETAILED DESCRIPTION

Autocorrelation Function (ACF)

Figure 1:
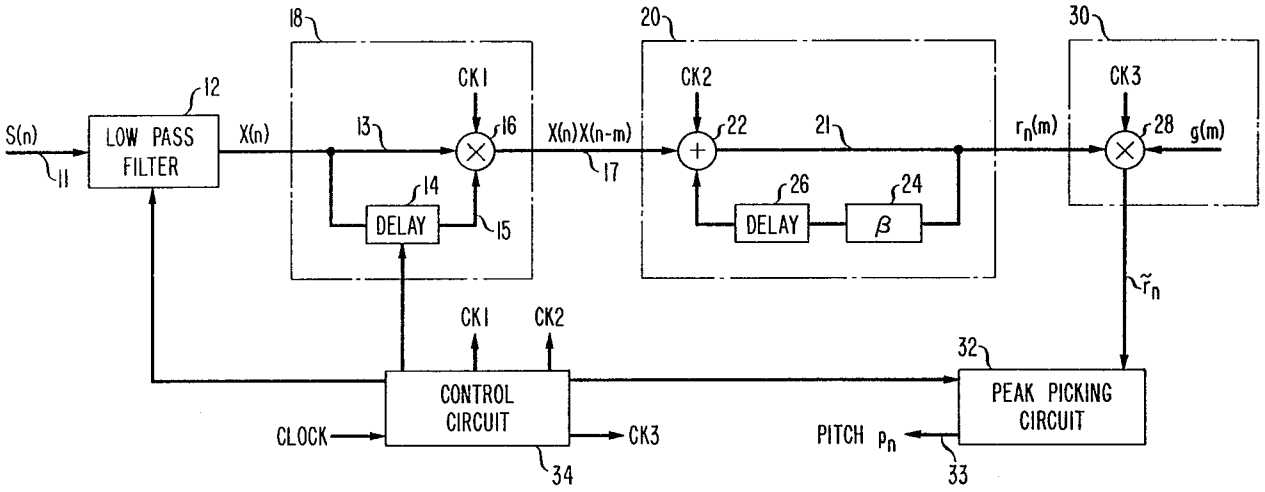
FIG. 1 (PRIOR ART)
FIG. 1 discloses a prior art circuit for determining the pitch period of a speech signal.

Referring to FIG. 1, there is shown a prior art circuit for estimating the pitch period by using the autocorrelation function (ACF). The ACF method is disclosed in a book by Messrs. L. R. Rabiner and R. W. Schafer, entitled "Digital Processing of Speech Signals," Prentice-Hall, Inc. (1978), at pages 150 to 158.

In FIG. 1, encoded samples s(n), at sample times n, of speech signals on lead 11 are passed through low pass filter 12 to eliminate formants of second and higher orders. Formants are resonant frequencies of the vocal tract. Second and higher order formants may interfere with the detection of the pitch period and hence are filtered out. Typically, the low pass filter 12 attenuates frequencies above one thousand Hertz (Hz). A sufficient number of pitch harmonics, however, are preserved.

The autocorrelation function (ACF) estimate $r_n(m)$, for time n, is defined as $$r_n(m) = \sum_{1=--} f(n-1)\, x(1)\, x(1-m) \qquad (1)$$

where, m=autocorrelation lag, f(n−1)=analysis window,

1=factor for varying the analysis window, x(1)=speech signal sample at time 1, and $x(1-m)$=delayed speech signal sample.

The largest value of $r_n(m)$ is selected, and the pitch period is estimated as being the corresponding lag or delay m.

The autocorrelation lag or delay m varies over a range (m), corresponding to the normal range of pitch for human speech. The filtered speech sample x(n) on lead 13 is also passed through the delay circuit 14 for producing a delayed sample $x(n-m)$ on lead 15. The filtered speech sample x(n) and the delayed sample $x(n-m)$ are multiplied at multiplier 16 and the product signal is delivered on lead 17 to the accumulator 20.

The accumulator 20, also known as a leaky integrator, performs the function of the analysis window, f(n). That is, the analysis window is a low pass filter for smoothing the product signal $x(n) \times (n-m)$ and equation (1) describes the convolution of f(n) with this product signal. This smoothing is achieved by multiplying the previous signal $r_{n-1}(m)$ by a coefficient, $\beta$, in circuit 24, by delaying the result by delay circuit 26, and adding the delayed result to the product signal $x(n) \times (n-m)$ in adder 22. The ACF estimate $r_n(m)$ appears on lead 21.

As stated above, the value of the lag or delay m associated with the largest value of $r_n(m)$ is an estimate of the pitch period. This lag is denoted $m_o$. Pitch doubling errors, however, may arise when the magnitude of the ACF is larger at a value of m which is twice that of the actual pitch value. In order to reduce such errors, the ACF estimate $r_n(m)$ is multiplied by a weighting factor, g(m), in multiplier 28 to yield the product $$\tilde{r}_n(m)=r_n(m)g(m) \tag{2}$$

The pitch, $p_n$, is computed from the lag or delay $m_o$ corresponding to the maximum value $\tilde{r}_n(m_o)$ selected over the range (m) by the peak picking circuit 32.

Figure 2:
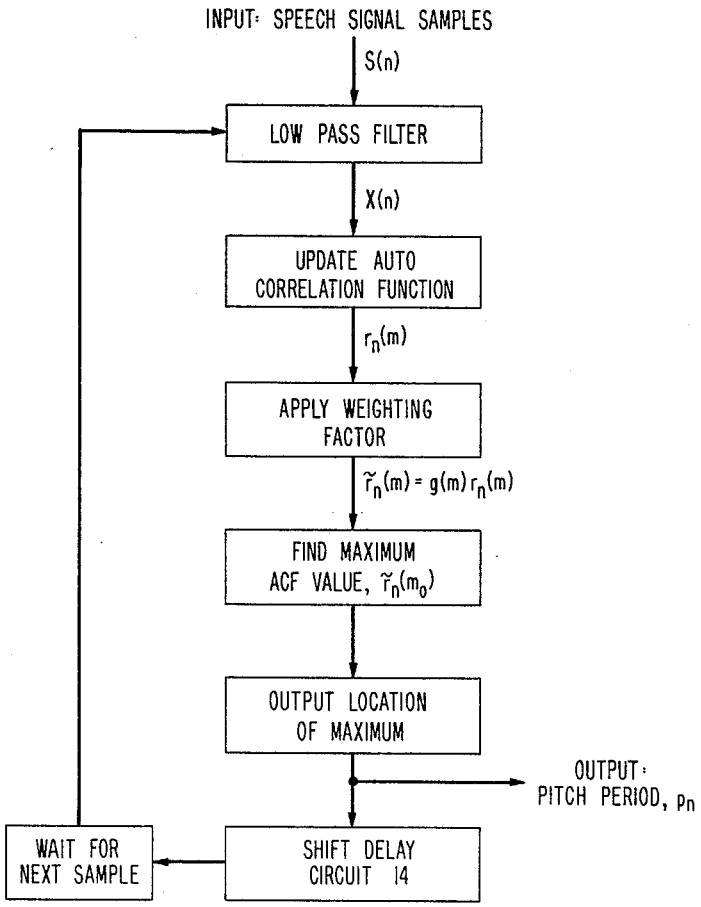
FIG. 2 (PRIOR ART)
FIG. 2 is a flow chart illustrative of the operations performed by the circuit in FIG. 1.

After the pitch period, $p_n$, has been estimated, the contents in the delay circuit 14, which is a buffer or shift register, are shifted. Simultaneously therewith, the control circuit 34 enables the low pass filter 12 to receive the next sample. The operations for estimating the pitch period, $p_n$, are shown summarized in the flow chart of FIG. 2.

The prior art method of pitch period estimation by the autocorrelation function method, however, requires a substantial amount of memory.

Modified Autocorrelation Function

Figure 3:
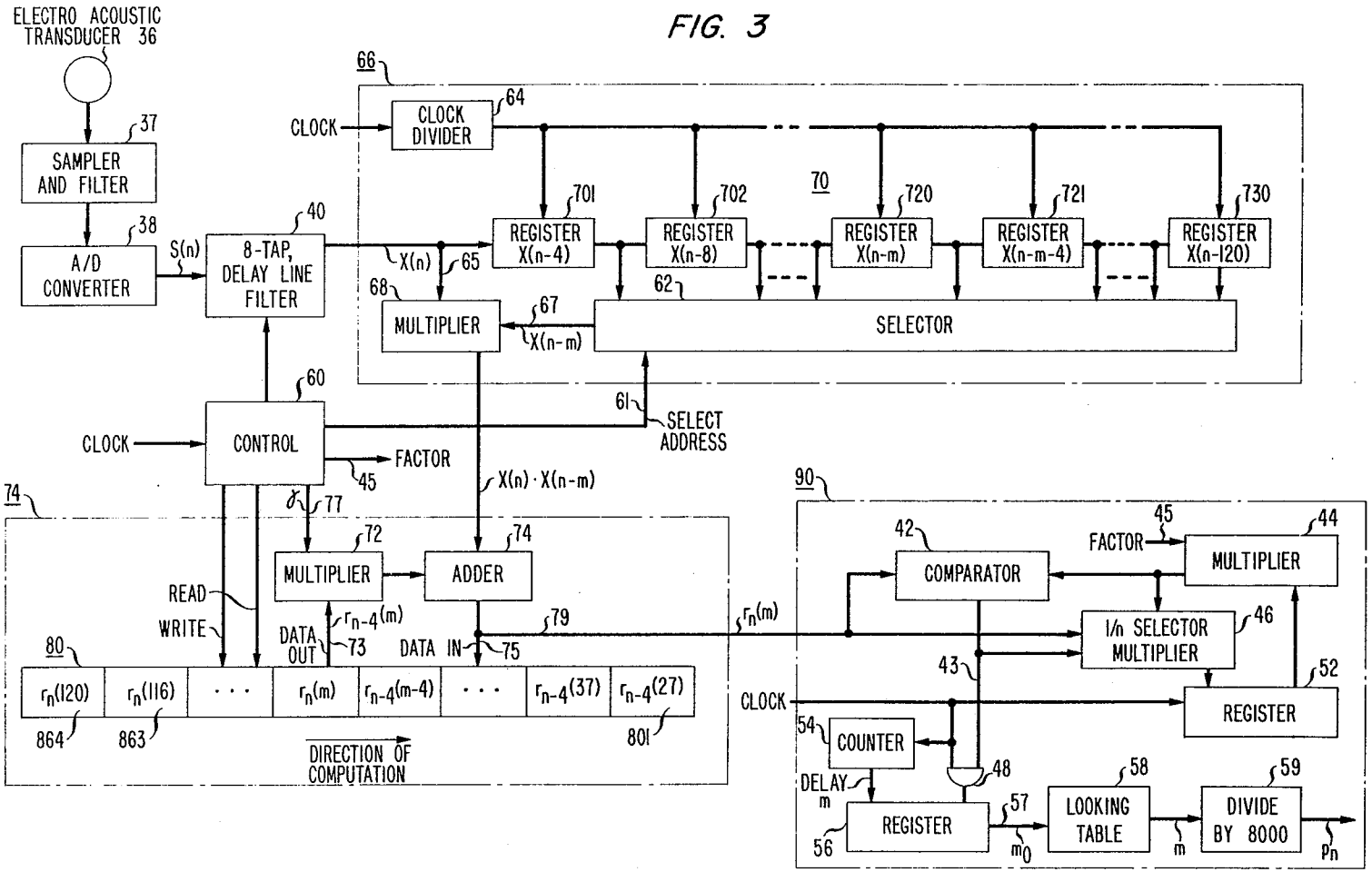
FIG. 3 is a circuit embodying the present invention for determining the pitch period of a speech signal.
Figure 4:
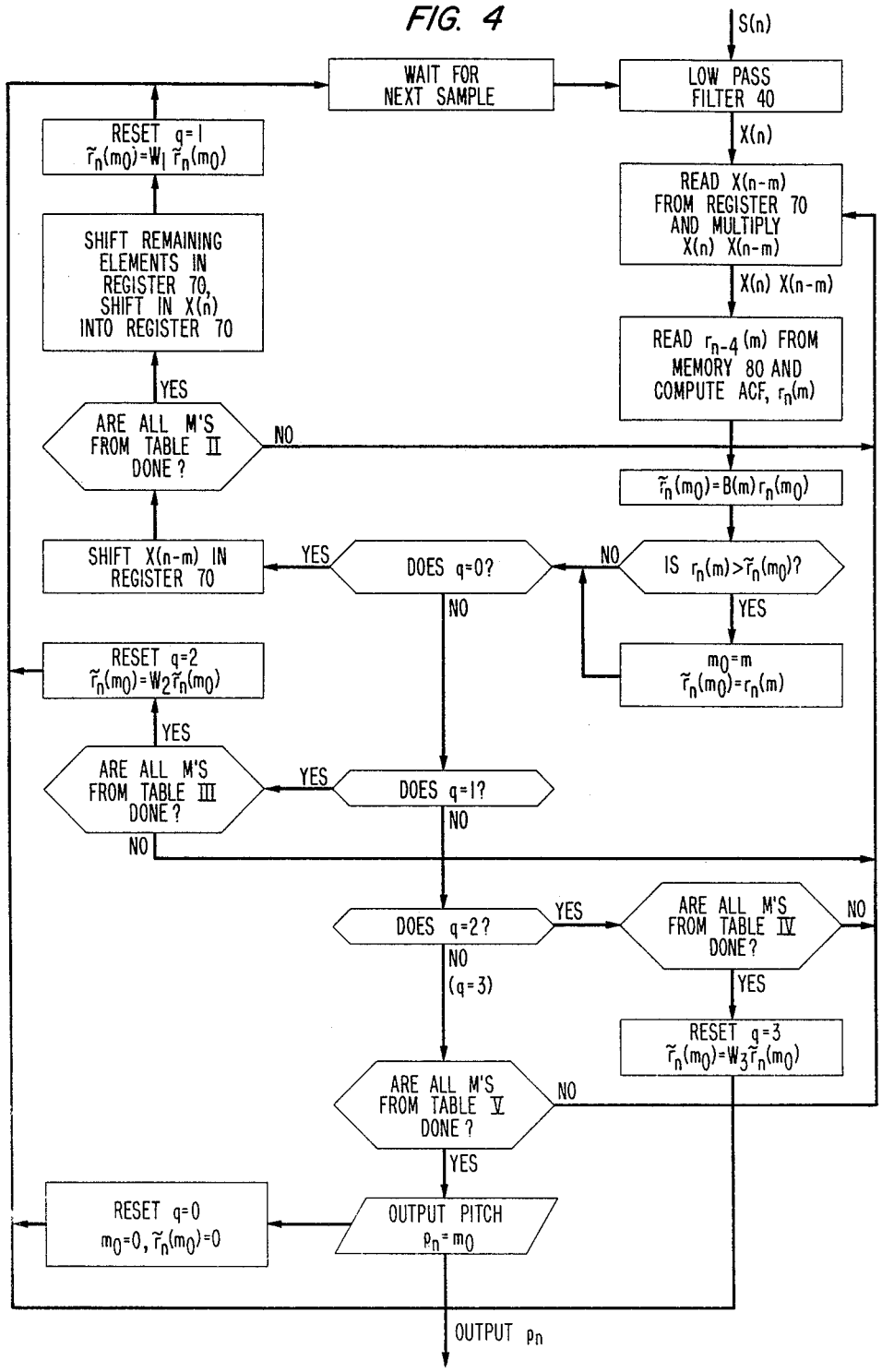
FIG. 4 is a flow chart illustrative of the sequence of operations performed by the circuit in FIG. 3.

Referring to FIG. 3, there is shown a circuit for calculating a modified autocorrelation function, to be described in detail hereinbelow. There is a flow chart shown in FIG. 4 summarizing the sequence of operations within FIG. 3. An acoustic signal is converted in electroacoustic transducer 36 to an electric signal which is periodically sampled in the sampler and filter circuit 37 and then converted to a digital signal in the analog-to-digital converter 38. Filter 40 is a low pass finite impulse response filter for attenuating beyond 1000 Hz the encoded digital samples s(n) of a speech signal, sampled at the rate of 8 KHz. The sample s(n) is shifted through the 8-tap, delay line filter 40, to produce an average signal x(n).

In the prior art circuit of FIG. 1, every sample was stored and used in computing the pitch period, $p_n$. Furthermore, in most prior art systems a block of samples would be processed together and scanned for the maximum weighted ACF, $\tilde{r}_n(m)$. In accordance with the preferred embodiment, however, there are two distinct improvements: samples are processed by stream processing, to be described more fully below; and, only every Qth signal sample, where Q=4, is stored for processing, thereby substantially reducing the amount of memory required for storing the signal samples. Indeed, every second, third, fourth, fifth, or sixth sample may be selected without resulting in any error in the pitch period estimate.

As stated hereinabove, the low pass filter 40 has a cut-off frequency of 1000 Hz because the first formant for most human speech falls below 1000 Hz. Furthermore, the speech signals are sampled at the rate of 8000 Hz per second. Combining these two factors, the delay or lag m is defined as the sampling rate divided by the pitch frequency. Thus, corresponding to the frequency 320 Hz, there is obtained a low m value of 25, i.e., 8000/320. Likewise, corresponding to the frequency 66.7 Hz, there is obtained a high m value of 120, i.e., 8000/66.7.

It is widely known that female speech signals have high pitch frequencies and male speech signals, low pitch frequencies. That is, female signals have low m values and male signals, high m values.

For many applications in speech coding and compression, a quantization comprising six bits for the pitch period is sufficient. In particular, when the pitch detector in the preferred embodiment is used in a speech coder, a six bit pitch estimate, updated every ten milliseconds gives good results. Thus, for a pitch code of six bits, a set of sixty-four elements ($2^6$) are required for storing the ACF estimates, $r_n(m)$.

As stated hereinabove, n refers to the instants in time when speech signals are sampled, and, in the preferred embodiment, every Qth sample, where Q=4, was selected for computing the autocorrelation function (ACF), $r_n(m)$. Also, Q may be 2, 3, 5, or 6, in other cases, with little error being obtained in the pitch estimate. Because sixty-four ACF estimates are required every fourth sample, it is necessary to multiply every fourth sample by sixty-four delayed samples or lags.

The relevant human pitch periods have a range of m from 25 to 120, as stated above, giving a total of ninety-six values. Because female signals have low m values, it is necessary to include all low values of m from 25 to about 56, a total of thirty-two values. Use of only integer values of m produced good results. For male signals, however, use of every other integer value of m produced equally good results. In the preferred embodiment, to capture male signals, even integer m values from 58 to 120, a set of thirty-two, were used. Thus, the set of sixty-four m values, $$m=\{25,26,27,28,\ldots 54,55,56,58,60,62\ldots 116,118,120\} \tag{3}$$

are selected for computing the sixty-four ACF estimates, from which the pitch period is obtained.

Because only every fourth signal sample is selected for processing, there are four cycles, q, that is, four sample times n, over which the sixty-four ACF estimates may be computed. The four cycles, q, are numbered 0, 1, 2, and 3 for convenience. Because only every fourth signal sample is stored, the pitch period estimate is updated only once for every four samples. This method, nevertheless, produces a good pitch estimate.

At each of the aforesaid cycles, q, only those autocorrelation lags are computed for which $$m=Qc+q \quad (4)$$

where c=0, 1, 2, 3, . . . , such that the values of m correspond to those in relationship (3), stated above. These m values are listed below, for convenience, in Tables I, II, III and IV for cycles q=0, 1, 2, and 3, respectively.

TABLE I

| Cycle q = 0 LOCATION IN REGISTERS 70 | m VALUE |
|---|---|
| 730 | 120 |
| 729 | 116 |
| 728 | 112 |
| 727 | 108 |
| 726 | 104 |
| 725 | 100 |
| 724 | 96 |
| 723 | 92 |
| 722 | 88 |
| 721 | 84 |
| 720 | 80 |
| 719 | 76 |
| 718 | 72 |
| 717 | 68 |
| 716 | 64 |
| 715 | 60 |
| 714 | 56 |
| 713 | 52 |
| 712 | 48 |
| 711 | 44 |
| 710 | 40 |
| 709 | 36 |
| 708 | 32 |
| 707 | 28 |

TABLE II

| Cycle q = 1 LOCATION IN REGISTERS 70 | m VALUE |
|---|---|
| 714 | 53 |
| 713 | 49 |
| 712 | 45 |
| 711 | 41 |
| 710 | 37 |
| 709 | 33 |
| 708 | 29 |
| 707 | 25 |

TABLE III

| Cycle q = 2 LOCATION IN REGISTERS 70 | m VALUE |
|---|---|
| 730 | 118 |
| 729 | 114 |
| 728 | 110 |
| 727 | 106 |
| 726 | 102 |
| 725 | 98 |
| 724 | 94 |
| 723 | 90 |
| 722 | 86 |
| 721 | 82 |
| 720 | 78 |
| 719 | 74 |
| 718 | 70 |
| 717 | 66 |
| 716 | 62 |
| 715 | 58 |
| 714 | 54 |
| 713 | 50 |
| 712 | 46 |
| 711 | 42 |
| 710 | 38 |
| 709 | 34 |
| 708 | 30 |
| 707 | 26 |

TABLE IV

| Cycle q = 3 LOCATION IN REGISTERS 70 | m VALUE |
|---|---|
| 714 | 55 |
| 713 | 51 |
| 712 | 47 |
| 711 | 43 |
| 710 | 39 |
| 709 | 35 |
| 708 | 31 |
| 707 | 27 |

Referring to FIG. 3 again, there is shown a register bank 70 comprising thirty shift registers 701, 702, 703, . . . 730 for storing every fourth signal sample. Thus, in register 730 there is stored the sample x(n−120) from 120 cycles ago, that is, the oldest sample. In register 701, there is stored the most recent sample x(n−4) from four cycles ago. A clock divider circuit 64 counts clock pulses and delivers clock signals to registers 701, 702, 703 . . . 730 once every Q sample periods or cycles to effect the shifting of signal samples x(n) through the aforesaid registers.

Under direction from the control circuit 60, a select address lead 61 is enabled, thereby causing the twenty-four registers 730, 729, 728 . . . 707, the m value contents of which are shown in Table I, to be read during cycle q=0. Thereafter, the current sample x(n) is shifted into register 701 of shift register 70. This is effected by adjusting the clock divider to enable the registers in bank 70 to be shifted, towards the end of the sample period. Thus, during cycle q=0, the current signal sample x(n) is multiplied, in multiplier 68, with each of twenty-four delayed signal samples x(n−m), the m values of which are stated in Table I.

Simultaneously, as each delayed sample, x(n−m), is read from the bank of shift registers 70, the corresponding ACF estimate, $r_{n-4}(m)$, is read from a memory device 80 and transferred to a multiplier 72 over lead 73. A factor $\gamma$, defined by equation (7) hereinbelow, is transferred from control circuit 60 over lead 77 to multiplier 72. The output from multiplier 72 is transferred to the adder 74. The multiplier 72 together with adder 74 are arranged to form a first-order infinite impulse response filter, known also as a weakly integrator, having an exponential window defined by $$f(n) = \gamma^n,\ n \geqq 0 \quad (5)$$
$$= 0,\ n < 0.$$

The aforesaid leaky integrator in FIG. 3, corresponding to filter 20 in FIG. 1, allows the autocorrelation function (ACF) estimates, $r_n(m)$, to be sequentially updated according to the difference equation:

$$r_n(m)=\gamma r_{n-Q}(m)+x(n)x(n-m) \quad (6)$$

where Q=2, 3, 4, 5 or 6.

The choice of $\gamma$ determines the time constant or duration of the windows. There is a relationship between $\gamma$ in equation (6), above, and $\beta$ in circuit 24 of FIG. 1, above:

$$\gamma=\beta^Q \quad (7)$$

Typically, $\gamma$ is 0.95, for Q=4. Because every fourth sample was selected, in the preferred embodiment, $\gamma=\beta^4$ was selected. In a six cycle embodiment, alternatively, $\gamma=\beta^6$ would be selected. Thus, in the preferred embodiment, equation (6) becomes:

$$r_n(m)=0.95r_{n-4}(m)+x(n)x(n-m) \quad (8)$$

More particularly, when delayed sample x(n−120) is read in cycle q=0, from register 730 in register bank 70, the corresponding ACF estimate, $r_{n-4}(120)$, is read from location 864 in memory 80. The delayed sample x(n−120) is multiplied with the current sample x(n) to yield the product signal x(n)x(n−120). Likewise, the window function coefficient, $\gamma=0.95$, is multiplied with the corresponding ACF estimate, $r_{n-4}(120)$, from four cycles ago to yield the product 0.95 $r_{n-4}(120)$. The two products are then added to give the updated ACF estimate, $r_n(m)$, that is, $r_n(120)$, appearing on lead 79. The updated ACF estimate, $r_n(120)$, is stored in location 864, where $r_{n-4}(120)$ was stored four cycles ago, of memory 80.

Thus during cycle q=0, twenty-four ACF estimates are updated by reading twenty-four delayed samples x(n−m), that is, x(n−120) to x(n−28), from register bank 70 and the corresponding prior ACF estimates $r_{n-4}(m)$, that is, $r_{n-4}(120)$ to $r_{n-4}(28)$, from memory 80. During that same cycle q=0, the twenty-four updated ACF estimates are stored once more in their corresponding locations in memory 80.

In the next cycle q=1, the next sample x(n+1) will not be shifted into register bank 70. That sample, x(n+1), will be multiplied, however, with each of eight previously stored samples x(n−53), x(n−49), x(n−45) . . . x(n−25) read out from shift registers 714, 713, 712 . . . 707, respectively, of register bank 70, to produce signal products x(n+1)x(n−53), x(n+1)x(n−49), x(n+1)x(n−45) . . . x(n+1)x(n−25).

As stated above, towards the end of the first cycle q=0, the then current sample x(n) was shifted into register bank 70, thereby requiring each sample to be shifted by one position to the right. Thus, referring to Table I, register 714 would contain, after the shift, the delayed sample 52. Because cycle g=1 is one cycle later, shift register location 714 will now contain the delayed sample 53, as shown in Table II. Likewise, in cycles 2 and 3, the location 714 will contain the delayed samples 54 and 55, respectively. The delayed samples processed from register bank 70 are shown in Table II. During cycle q=1, eight ACF estimates are updated from locations 840 to 833 in memory 80.

Likewise, during cycles q=2 and q=3, twenty-four and eight ACF estimates are updated, respectively, for the sample signals x(n+2) and x(n+3). At the end of the fourth cycle, the process is repeated. Thus, by updating sixty-four ACF estimates over a period of four cycles, there is obtained a substantial reduction in the storage space required for dynamic variables.

As described hereinabove, twenty-four ACF estimates are processed during each of cycles 0 and 2 and eight ACF estimates are processed during each of cycles 1 and 3. On an average, however, only sixteen ACF estimates can be processed during each cycle. This can be achieved by storing the sample signal s(n+1) in cycle 1 in a storage device (not shown) until the remaining eight ACF estimates from cycle 0 are processed. Thereafter, the ACF estimates from cycle 1 are processed. This process is repeated for cycles 2 and 3.

Referring briefly to FIG. 1, there is shown a weighting circuit 30 and a circuit 32 for selecting the weighted autocorrelation function (ACF) estimate. The weighting factor, introduced by circuit 30 and shown in equation (7), is used for reducing the possibility of pitch doubling errors. These functions are combined in circuit 90 in FIG. 3.

As stated hereinabove, the impetus for this invention was to reduce the storage space needed during processing for estimating the pitch period. If all the weighted values, g(m) $r_n(m)$, for the sixty-four ACF estimates, $r_n(m)$, were stored before the maximum valued weighted ACF estimate was selected, sixty-four additional storage locations would be required.

The aforesaid storage requirement for the weighted ACF estimates is substantially reduced by the following method. The weighting factor, g(m), is selected so that a discounting factor, B(m), which is the ratio of any two successive values of the weighting factor, g(m) and g(m+4), spaced four cycles apart, is defined by the following equation:

$$B(m) = \frac{g(m+4)}{g(m)}, \quad (9)$$

$$= 1.0, \text{ for } m \leqq 36$$
$$= 0.99005, \text{ for } m \geqq 37$$

Thus, the first ACF estimate $r_n(m)$, namely, $r_n(120)$ in cycle q=0, is multiplied by the discounting factor, B(120)=0.99005, and the resulting product $r_n(120)B(120)$ is then compared with the second ACF estimate, $r_n(116)$ in cycle 0. The larger value and its corresponding delay or index, $m_o$, are saved. This process is repeated for all sixty-four ACF estimates.

The aforesaid weighing process is implemented by transferring the ACF estimate, $r_n(m)$, over lead 79 as one input to comparator 42. The other input to comparator 42 is delivered from multiplier 44. Thus, for example, if the input to comparator 42 on lead 79 is $r_n(116)$, the other input to comparator 42 from multiplier 44 is $r_n(120)B(120)$. If $r_n(116)$ is larger than $r_n(120)B(120)$, then the signal on output lead 43 from comparator 42 enables AND gate 48 and the 1/n selected multiplexor 46.

Multiplexor 46 has as its input signals the ACF estimate $r_n(m)$ from lead 79 and the output signal from multiplier 44. If the output lead 43 from comparator is enabled, $r_n(116)$ is larger than $r_n(120)B(120)$ in the example, and $r_n(m)$, that is $r_n(116)$ in the example, is allowed to flow through multiplexor 46 into register 52. On the other hand, if $r_n(116)$ is less than $r_n(120)B(120)$, the output from the multiplier 44, that is $r_n(120)B(120)$ in the example flows through multiplexor 46 into register 52.

Thus, the larger of the two quantities, as aforesaid, will always be entered in register 52. The contents from register 52 is then clocked as one input to multiplier 44. The other input to multiplier 44 is the aforesaid discounting factor, B(m), transferred over lead 45 from control circuit 60.

Clock pulses index a six-bit module counter 54. The output from counter 54 corresponds to the delay m and is the input to register 56. As stated hereinabove, when the current ACF estimate, $r_n(116)$ in the example, is greater than the output from multiplexor 44, $r_n(120)B(120)$ in the example, AND gate 48 will be enabled. When AND gate 48 is enabled, register 56 is enabled, thereby permitting the lag or delay m to be read out, over lead 57, as the hitherto maximum delay $m_o$.

A problem arises, however, in transitions from one cycle to another. For example, the last weighted ACF estimate in cycle 0 is $r_n(28)$. The first ACF estimate in cycle 1 is $r_n(53)$. Thus, after the last weighted ACF estimate $r_n(28)$ in cycle 0 is computed, a compensating factor, $W_1$, must be used to correct the discounting factor, B(m):

$$W_1 = \frac{g(28)}{g(53)} \tag{10}$$

The compensating factor $W_1$, is applied by multiplying the last maximum weighted ACF estimate in cycle 0, that is, $W_1 r_n(m_o)$.

Likewise, correcting factors $W_2$ and $W_3$ are applied to the last maximum weighted ACF estimate in each of the cycles 1 and 2 respectively.

$$W_2 = \frac{g(25)}{g(118)} \tag{11}$$

$$W_3 = \frac{g(26)}{g(55)} \tag{12}$$

By the method in the present invention, there is a substantial reduction in the need for storage space.

By the aforesaid method, the largest weighted ACF estimate is obtained once for every four cycles. The corresponding location of $m=m_o$, is identified. From this $m_o$ value, the corresponding m value may be determined by referring to Table V, the contents of which are stored in a memory device 58, such as a ROM. The pitch period, $p_n$, is determined, as stated hereinabove, to be m/8000 by the divider circuit 58, and appears on lead 91.

TABLE V

| $m_o$ Value | m Value | $m_o$ Value | m Value |
|---|---|---|---|
| 0 | 120 | 32 | 118 |
| 1 | 116 | 33 | 114 |
| 2 | 112 | 34 | 110 |
| 3 | 108 | 35 | 106 |
| 4 | 104 | 36 | 102 |
| 5 | 100 | 37 | 98 |
| 6 | 96 | 38 | 94 |
| 7 | 92 | 39 | 90 |
| 8 | 88 | 40 | 86 |
| 9 | 84 | 41 | 82 |
| 10 | 80 | 42 | 78 |
| 11 | 76 | 43 | 74 |
| 12 | 72 | 44 | 70 |
| 13 | 68 | 45 | 66 |
| 14 | 64 | 46 | 62 |
| 15 | 60 | 47 | 58 |
| 16 | 56 | 48 | 54 |
| 17 | 52 | 49 | 50 |
| 18 | 48 | 50 | 46 |
| 19 | 44 | 51 | 42 |
| 20 | 40 | 52 | 38 |
| 21 | 36 | 53 | 34 |
| 22 | 32 | 54 | 30 |
| 23 | 28 | 55 | 26 |
| 24 | 53 | 56 | 55 |
| 25 | 49 | 57 | 51 |
| 26 | 45 | 58 | 47 |
| 27 | 41 | 59 | 43 |
| 28 | 37 | 60 | 39 |
| 29 | 33 | 61 | 35 |
| 30 | 29 | 62 | 31 |
| 31 | 25 | 63 | 27 |

Because four cycles are used for computing each pitch period, $p_n$, there is a reduction in storage space required. Furthermore, because, on an average, only sixteen ACF estimates need be computed per cycle, a slower machine may be used. Whereas the invention has been described using shift registers and other integrated circuitry, these circuits may be incorporated in a single chip microprocessor such as the digital signal processor described in *The Bell System Technical Journal,* Volume 60, Number 7, Part 2, Sept. 3, 1981. More particularly, a block diagram of the aforesaid microprocessor appears at page 1433, therein.

The control operations for such a microprocessor may be permanently stored therein in a programmed sequence. A listing of the stored control program sequence for the microprocessor, described in the aforesaid BSTJ volume, to determine the pitch period in accordance with the present invention is included as an appendix hereto.

Although the preferred embodiment has disclosed a pitch detector for speech patterns, the invention is equally applicable for detecting periodicity in sound wave patterns, for example, music.

We claim:

1. A method for detecting the pitch of a speech pattern, comprising the steps of:

sampling a speech pattern at spaced time intervals to form a series of sample signals representative of the pattern;

gating every $Q^{th}$ sample, Q between 2 and 6, into a storage device, thereby storing a predetermined number of past samples, and processing said original samples and said stored $Q^{th}$ samples to generate a signal representative of the pitch of the speech pattern.

2. The method of pitch detection according to claim 1 wherein said processing step further comprises the steps of sequentially retrieving said stored sample signals, and multiplying each sample signal with each one of said stored sample signals to form a product signal.

3. The method of pitch detection according to claim 2 wherein said processing step further comprises the step of generating an autocorrelation function (ACF) estimate signal responsive to said product signals from the first sequence of Q consecutive sample signals.

4. The method of pitch detection according to claim 3 wherein said processing step further comprises the steps of retrieving the ACF estimate, generated Q sample time intervals ago, and generating an updated ACF estimate signal responsive to said product signals from the subsequent sequences of Q consecutive sample signals.

5. The method of pitch detection according to claim 4 wherein said processing step further comprises the steps of (1) multiplying said recomputed ACF estimate by a weighting factor, and (2) selecting the maximum valued weighted ACF estimate signal.

6. The method of pitch detection according to claim 5 wherein said processing step further comprises the steps of generating a signal representative of the occurrence of said largest of said weighted ACF estimates, and producing a signal corresponding to the pitch in response to said representative signal.

7. Apparatus for detecting the pitch of a speech pattern comprising:

means for sampling a speech pattern at spaced time intervals to form a series of sample signals representative of the pattern;

means for gating every $Q^{th}$ sample, Q between 2 and 6, into a storage device, thereby storing a predetermined number of past samples, and means for processing said original samples and said stored $Q^{th}$ samples to generate a signal representative of the pitch of the speech pattern.

8. The apparatus for detecting the pitch of a speech pattern according to claim 7 further comprising means for sequentially retrieving said stored sample signals, and means for multiplying each consecutive sample signal with a plurality of said stored sample signals to form a product signal.

9. The apparatus for detecting the pitch of a speech pattern according to claim 8 further comprising means for generating an autocorrelation function (ACF) estimate signal responsive to said product signals from the first sequence of Q consecutive sample signals.

10. The apparatus for detecting the pitch of a speech pattern according to claim 9 further comprising means for retrieving the ACF estimate, generated Q sample time intervals ago, and means for generating an updated ACF estimate signal, responsive to said product signals from the subsequent sequences of Q consecutive sample signals.

11. The apparatus for detecting the pitch of a speech pattern according to claim 10 further comprising means for multiplying said recomputed ACF estimate by a weighting factor, and means for selecting the largest weighted ACF estimate signal.

12. The apparatus for detecting the pitch of a speech pattern according to claim 11 further comprising means for generating a signal representative of the occurrence of the largest of said weighted ACF estimates, and means responsive to said representative signal for producing a signal corresponding to the pitch.

* * * * *